US007234201B2

(12) United States Patent
Brown et al.

(10) Patent No.: US 7,234,201 B2
(45) Date of Patent: Jun. 26, 2007

(54) DOOR CLOSER POWER ADJUSTING DEVICE

(75) Inventors: Peter Edward Brown, Alveley (GB); George Toledo, Fallbrook, CA (US)

(73) Assignee: Jackson Corporation, Los Angeles, CA (US)

( * ) Notice: Subject to any disclaimer, the term of this patent is extended or adjusted under 35 U.S.C. 154(b) by 0 days.

(21) Appl. No.: 10/890,570

(22) Filed: Jul. 14, 2004

(65) Prior Publication Data

US 2005/0011040 A1 Jan. 20, 2005

(51) Int. Cl.
*E05F 3/00* (2006.01)
*E05F 11/00* (2006.01)

(52) U.S. Cl. ..... 16/79; 16/71; 49/334

(58) Field of Classification Search ..... 16/79, 16/71, 62, 58, 51, 76, 69, 49, 52, 53, 85, 16/DIG. 9, DIG. 10; 49/29, 326, 334, 335, 49/340–342, 348, 349, 357
See application file for complete search history.

(56) References Cited

U.S. PATENT DOCUMENTS 3,246,362 A 4/1966 Jackson
3,875,612 A * 4/1975 Poitras ..... 16/48.5
3,935,614 A * 2/1976 Pannone et al. ..... 16/48.5
4,064,589 A 12/1977 Bejarano et al.
4,159,598 A * 7/1979 Gatland et al. ..... 49/28
4,220,051 A * 9/1980 Catlett ..... 74/89.25
4,267,619 A * 5/1981 Suska ..... 16/48.5
4,763,937 A * 8/1988 Sittnick et al. ..... 292/251.5
4,803,754 A * 2/1989 Roberts ..... 16/49
4,995,194 A * 2/1991 Schultze et al. ..... 49/32
5,193,647 A * 3/1993 O'Brien, II ..... 185/40 R
5,592,780 A * 1/1997 Checkovich ..... 49/386
5,666,692 A 9/1997 Toledo
5,687,451 A * 11/1997 Singer ..... 16/71
5,913,763 A * 6/1999 Beran et al. ..... 49/506
6,108,975 A * 8/2000 Bailey ..... 49/334
6,223,469 B1 * 5/2001 Moll ..... 49/341

* cited by examiner

*Primary Examiner*—Robert J. Sandy
*Assistant Examiner*—Andre' L. Jackson
(74) *Attorney, Agent, or Firm*—Greer Burns & Crain, Ltd

(57) ABSTRACT

A door closer power adjusting device for a door closer having a spindle driven by a compressed spring with a movable plate for adjusting spring compression, or with a screw for adjusting spring compression, between a high and low level of compression. A powered unit moves the plate in a first direction to achieve the low level of compression and in a second direction to achieve the high level of compression. A switch activates the powered unit in the first direction and a first switch is engaged when the spring is compressed to the low level of compression to deactivate the powered unit. A timing circuit activates the powered unit in a second direction after passage of a predetermined time. A second switch is engaged when the spring is compressed to the high level of compression to deactivate the powered unit.

19 Claims, 2 Drawing Sheets

DOOR CLOSER POWER ADJUSTING DEVICE

BACKGROUND OF THE INVENTION

The present invention relates to spring powered door closers, such as disclosed in U.S. Pat. Nos. 3,246,362, 4,064,589, and 5,666,692, which disclosures are incorporated herein by reference. In such closers it is known that the closing power or force required to open the door against the spring force of the closer can be adjusted by providing greater or lesser compression of the springs in the closer. This can be accomplished by rotating a screw that moves a plate internally of the closer body that further compresses the spring, or allows the spring to expand, depending upon the direction of rotation of the screw. Such an arrangement is disclosed in the '692 patent.

SUMMARY OF THE INVENTION

The present invention allows the power of the closer to be adjusted by a user through the use of a powered arrangement, rather than through a manual operation by the user. Such a device is particularly useful to allow for greater accessibility to spaces closed by heavy doors, or doors with high powered door closers. In some situations, it is necessary to have a door closer high powered, such as to assure that the door remains in a closed position when the door is subject to high wind forces, or where the ambient pressure in the building or closed space is significantly different from the ambient pressure outside of the building or closed space.

A drawback of a high powered door closer is that it may be difficult for all persons to open the door against the normal high power of the closer. For this reason, a device according to the present invention is provided to adjust the power of the door closer to a much lower power, upon receipt of a signal from such a user, so that the door can be opened more easily. After a set time, the power of the door closer will be returned to the higher power level to provide the security to the building or space normally provided by the closed door.

DETAILED DESCRIPTION OF THE PREFERRED EMBODIMENT

Figure 1:
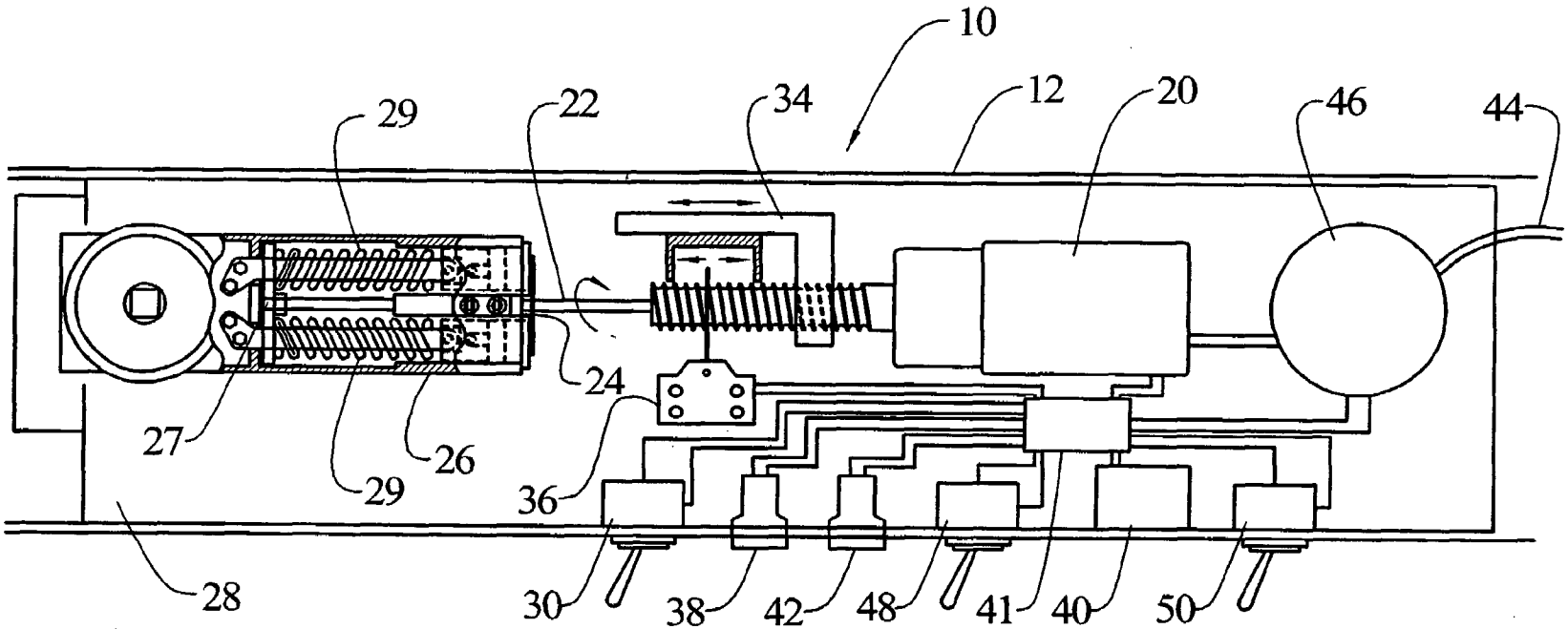
FIG. 1 illustrates a plan view of the interior of a door closer power adjusting device embodying the principles of the present invention.

In an embodiment of the invention, as illustrated in FIG. 1, door closer power adjusting device 10 includes a housing 12 for accommodating a number of internal components. One of the components, a powered unit in the form of a high torque motor 20, such as a 12 volt portable drill motor, can be used to rotate a shaft 22 connected, via an appropriate interface, to a power adjustment screw 24 of a door closer 26. The motor 20 and shaft 22 can be located in a door transom 28 so that they are not visible to the user during normal usage. Other types of powered units may be utilized to move a plate 27 in the door closer 26 against which one or more springs 29 in the door closer are compressed, including other types of motors, gear arrangements, and hydraulic or pneumatic movable pistons which may move the plate directly without use of a rotatable adjustment screw.

A switch 30 may be provided to allow the user to activate the motor 20 to rotate the power adjustment screw 24 to lower the power required to open the door. The switch may be in the form of a touch pad, push button, toggle switch, motion detector, infra red proximity switch or other known arrangements, including a remotely operated switch using a wired or wireless connection.

The shaft 22 of the motor 20 can carry an external thread 32, on which is carried a traveling nut 34, which moves into engagement with a limit switch 36 to deactivate the motor once the power adjustment screw 24 has rotated sufficiently to lower the power of the door closer 26 to an appropriate level. The limit switch 36 may also be carried on the nut 34 and moved into engagement with a fixed stop member to operate the switch once the shaft has rotated sufficiently. A similar arrangement could be used if a movable piston were used.

A signal device 38, such as a green light, for example a green LED, can be illuminated to signal to the user that the door closer 26 has reached the low power state. Other types of visible or audible signaling devices could also be used.

After the passage of a predetermined time period, as determined by an electronic timing circuit 40, sending a signal through a control unit 41 that all of the electrical devices are connected to, the motor 20 is reversed and the shaft 22 is rotated in the opposite direction to return the closer 26 to the higher power setting. Again, the nut 34 carried on the shaft 22 can be used to engage the limit switch 36 to terminate operation of the motor 20 when the shaft 22 has rotated a sufficient amount to return the closer 26 to the high power setting. Thus, the two switching functions associated with the movement of the nut 34 on the shaft 22 can be accomplished by a single switch having two engagement positions.

A further signal device 42, such as a red light, for example, a red LED, can be illuminated to signal to the user that the door closer 26 is no longer in the low power state and/or is in the high power state. This signal device 42 may be activated as soon as the motor 20 is activated to return the closer 26 to the high power setting, and may remain activated until such time as the closer is fully returned to the low power setting. Again, other types of signaling devices as described above could be used.

The motor 20 may be powered through a normal 110 volt ac power line 44, which electrical power is converted to 12 volt dc power at a voltage converter unit 46.

An override switch 48 may be provided to return the power setting for the door closer 26 to the high power, in advance of the normal time delay, if desired. This switch 48 may be constructed identically to or differently from the switch 30.

Also, a complete override switch 50 may be provided to disconnect the switches 30, 48 for changing the power setting for the door closer 26 if that is desired as well. This complete override switch may be located remotely from the door.

Figure 2:
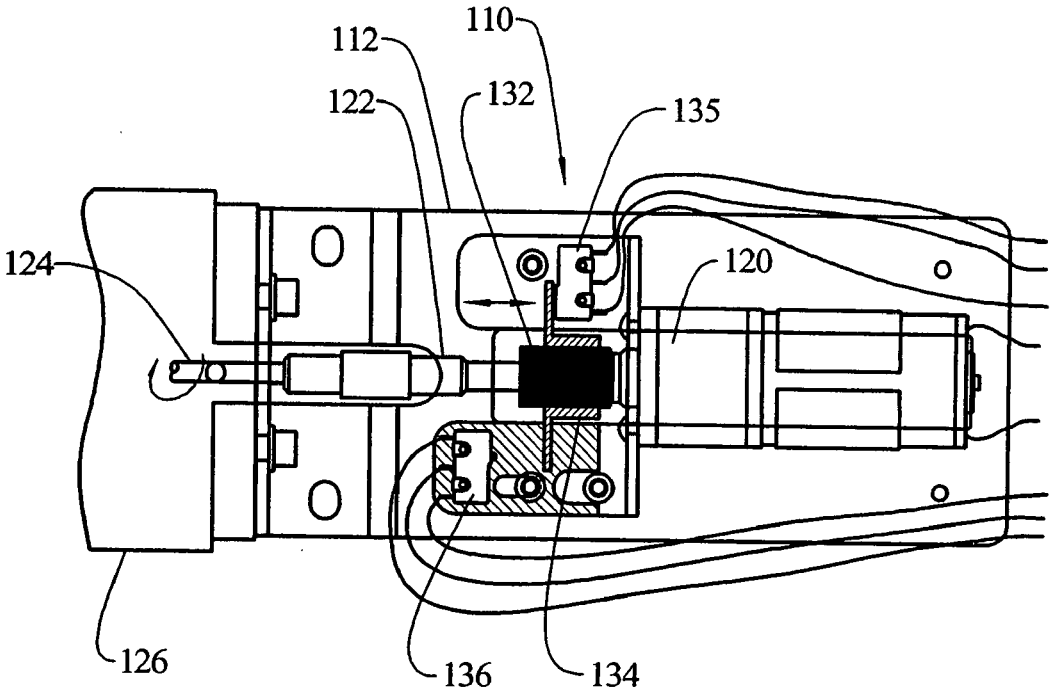
FIG. 2 illustrates a plan view of the interior of an alternative embodiment of a door closer power adjusting device embodying the principles of the present invention.
Figure 3:
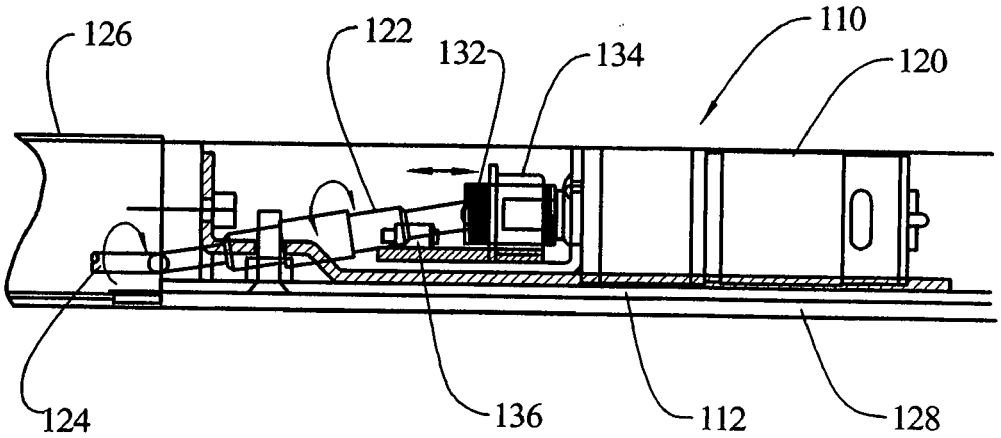
FIG. 3 illustrates a side view of the interior of the device of FIG. 2.

In another embodiment of the invention, as illustrated in FIGS. 2 and 3, door closer power adjusting device 110 includes a housing 112 for accommodating a number of internal components. One of the components, a powered unit in the form of a high torque motor 120, such as a 12 volt portable drill motor, can be used to rotate a shaft 122 connected, via an appropriate interface, to a power adjustment screw 124 of a door closer 126 of the type described above. The motor 120 and shaft 122 can be located in a door transom 128 so that they are not visible to the user during normal usage. Other types of powered units may be utilized to move a plate in the door closer 126 against which one or more springs in the door closer are compressed, including other types of motors, gear arrangements, and hydraulic or pneumatic movable pistons which may move the plate directly without use of a rotatable adjustment screw.

A switch as described above with regard to switch 30, may be provided to allow the user to activate the motor 120 to rotate the power adjustment screw 124 to lower the power required to open the door. The switch may be in the form of a touch pad, push button, toggle switch, motion detector, infra red proximity switch or other known arrangements, including a remotely operated switch using a wired or wireless connection.

The shaft 122 of the motor 120 can carry an external thread 132, on which is carried a traveling nut 134, which moves into engagement with a limit switch 135, 136 at each end of its travel to deactivate the motor once the power adjustment screw 124 has rotated sufficiently to lower the power of the door closer 126 to an appropriate level, or has returned to its initial, full power position. The two positions of the nut 134 can thus be detected by two separate switches. A similar arrangement could be used if a movable piston were used.

As in the embodiment described above with respect to FIG. 1, a signal device (not separately shown here), such as a green light, for example a green LED, can be illuminated to signal to the user that the door closer 126 has reached the low power state. Other types of visible or audible signaling devices could also be used.

After the passage of a predetermined time period, as determined by an electronic timing circuit as described previously, sending a signal through a control unit that all of the electrical devices are connected to, the motor 120 is reversed and the shaft 122 is rotated in the opposite direction to return the closer 126 to the higher power setting. Again, the nut 134 carried on the shaft 122 can be used to engage the first limit switch 135 to terminate operation of the motor 120 when the shaft 122 has rotated a sufficient amount to return the closer 126 to the high power setting. The two switches 135, 136 could be incorporated into a single switch if desired.

A further signal device as described with respect to FIG. 1, such as a red light, for example, a red LED, can be illuminated to signal to the user that the door closer 126 is no longer in the low power state and/or is in the high power state. This signal device may be activated as soon as the motor 120 is activated to return the closer 126 to the high power setting, and may remain activated until such time as the closer is fully returned to the low power setting. Again, other types of signaling devices as described above could be used.

The motor 120 may be powered through a normal 110 volt ac as described above, which electrical power is converted to 12 volt dc power at a voltage converter unit.

An override switch as described above may be provided to return the power setting for the door closer 126 to the high power, in advance of the normal time delay, if desired. This switch may be constructed identically to or differently from the other user operable switches.

Also, as described above, a complete override switch may be provided to disconnect the user operated switches for changing the power setting for the door closer 126 if that is desired as well. This complete override switch may be located remotely from the door.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive or privilege is claimed are defined as follows:

1. A door closer power adjusting device for use with a door closer having a door engaging spindle rotatably driven by a spring with an adjusting screw for adjusting an amount of compression of said spring, comprising:

a shaft connected to said adjusting screw to rotatably drive said adjusting screw, a reversible motor connected to said shaft to rotatably drive said shaft without rotatably driving said spindle, a power supply for said motor, a switch to activate said motor in a first direction, a first switch arranged to be engaged upon said shaft rotating a sufficient number of times to adjust said compression of said spring to a predetermined level and to deactivate said motor when said compression of said spring reaches the predetermined level, a timing circuit to activate said motor in a second direction after the passage of a predetermined amount of time following said deactivation of said motor by said first switch, a second switch arranged to be engaged upon said shaft rotating a sufficient number of times to return said compression of said spring to its original level and to deactivate said motor when said compression of said spring reaches the original level.

2. A door closer power adjusting device according to claim 1, wherein said first and second switches comprise a single switch with two engagement positions.

3. The door closer power adjustment device according to claim 1, including an override switch to activate said powered unit in a second direction in advance of activation via said timing circuit.

4. The door closer power adjustment device according to claim 1, including an override switch engaged independently of the position of the door, to prevent operation of said switch to activate said motor in said first direction.

5. The door closer power adjustment device according to claim 1, including a signal device to alert a user that the door closer spring is at the predetermined compression level.

6. The door closer power adjustment device according to claim 5, wherein said signal device comprises a green illuminated device.

7. The door closer power adjustment device according to claim 1, including a signal device to alert a user that the door closer spring is at the first higher compression level.

8. The door closer power adjustment device according to claim 7, wherein said signal device comprises a red illuminated device.

9. A door closer power adjusting device for use with a door closer having a door engaging spindle rotatably driven by a compressed spring with a movable plate for adjusting an amount of compression of said spring between a first level of compression and a second level of compression, comprising:

a powered unit arranged to move said plate in a first direction to achieve said second level of compression and in a second direction to achieve said first level of compression without rotatably driving said spindle, a user engageable switch to activate said powered unit in said first direction, a first switch arranged to be engaged upon said spring being compressed to said second level of compression to deactivate said powered unit, a timing circuit to activate said powered unit in a second direction after the passage of a predetermined amount of time following said deactivation of said powered unit by said first switch, a second switch arranged to be engaged upon said spring being compressed to said first level of compression to deactivate said powered unit.

10. A door closer power adjusting device according to claim 9, wherein said first and second switches comprise a single switch with two engagement positions.

11. The door closer power adjustment device according to claim 9, including an override switch to activate said powered unit in a second direction in advance of activation via said timing circuit.

12. The door closer power adjustment device according to claim 9, including an override switch engaged independently of the position of the door, to prevent operation of said user engageable switch.

13. The door closer power adjustment device according to claim 9, wherein said powered unit comprises a reversible motor.

14. The door closer power adjustment device according to claim 13, wherein said motor is connected via a shaft to an adjustment screw engaged with said plate to provide the adjustment to the compression of said spring upon rotation of said shaft via said motor.

15. The door closer power adjustment device according to claim 9, including a signal device to alert a user that the door closer spring is at the second lower compression level.

16. The door closer power adjustment device according to claim 15, wherein said signal device comprises a green illuminated device.

17. The door closer power adjustment device according to claim 9, including a signal device to alert a user that the door closer spring is at the first higher compression level.

18. The door closer power adjustment device according to claim 17, wherein said signal device comprises a red illuminated device.

19. A door closer power adjusting device for use with a door closer having a door engaging spindle rotatably driven by a compressed spring movable between a first level of compression and a second level of compression, comprising:

a powered unit for moving said spring in a first direction to achieve said second level of compression without rotating said spindle and in a second direction to achieve said first level of compression, a user activated switch to activate said powered unit in said first direction, a first switch arranged to be engaged upon said spring being compressed to said second level of compression to deactivate said powered unit, a timing circuit to activate said powered unit in a second direction after the passage of a predetermined amount of time following the deactivation of said powered unit by said first switch, a second switch arranged to be engaged upon said spring being compressed to said first level of compression to deactivate said powered unit.

* * * * *